United States Patent [19]

Huffman et al.

[11] Patent Number: 4,684,273

[45] Date of Patent: Aug. 4, 1987

[54] RIBBON SHIELD FOR IMPACT PRINTER AND METHOD FOR CONTROLLING INK FLOW THEREIN

[75] Inventors: John W. Huffman; Brian J. Picht, both of Boise; Ben B. Tyson, Eagle, all of Id.

[73] Assignee: Hewlett-Packard Company, Palo Alto, Calif.

[21] Appl. No.: 740,469

[22] Filed: May 30, 1985

[51] Int. Cl.[4] ..... B41J 33/32

[52] U.S. Cl. ..... 400/247; 400/191; 400/124

[58] Field of Search ..... 400/202, 202.2, 247, 400/191, 248, 124

[56] References Cited

U.S. PATENT DOCUMENTS

| | | | |
|---|---|---|---|
| 383,480 | 5/1888 | Osborne | 400/247 |
| 398,837 | 3/1889 | Loker, Jr. | 400/247 |
| 471,092 | 3/1892 | Bigelow | 400/247 X |
| 4,383,775 | 5/1983 | Trammell et al. | 400/248 X |

FOREIGN PATENT DOCUMENTS

| | | | |
|---|---|---|---|
| 24183 | 3/1981 | Japan | 400/247 |
| 55784 | 3/1984 | Japan | 400/247 |

OTHER PUBLICATIONS

IBM Tech. Disc. Bulletin, "Ribbon Shield", vol. 27, No. 10B, Mar. 1985, pp. 6346–6347.

*Primary Examiner*—Edgar S. Burr
*Assistant Examiner*—James R. McDaniel
*Attorney, Agent, or Firm*—William J. Bethurum

[57] ABSTRACT

A ribbon shield for a dot matrix printer which is comprised of a step contoured recessed cavity such that the ribbon sequentially wipes against an upper edge, a lower edge, towards the paper, the other lower edge and the other upper edge and the ink removed accumulates in the cavity whereby it is restrained from flowing onto the paper.

6 Claims, 7 Drawing Figures

RIBBON SHIELD FOR IMPACT PRINTER AND METHOD FOR CONTROLLING INK FLOW THEREIN

FIELD OF THE INVENTION

This invention relates generally to dot matrix impact printers and more particularly to an improved ribbon shield and related method used in such printers for limiting the undesirable transfer of ink from the ribbon to the paper on which impact printing takes place.

BACKGROUND

In the art of impact printing, it is known to provide a metal shield between a traveling ink-containing ribbon and the paper upon which characters are printed. In an individual impact printing step, a stylus on one side of the ribbon drives the ribbon through an opening in the metal ribbon shield and into contact with the paper where the stylus comes to rest against a platen. Typically, the mechanical force for providing this motion to the stylus is produced electromagnetically, such as by controlled current pulses. The function of the ribbon shield is to prevent unintentional contact of the ribbon with the paper, and this requirement is particularly essential in printers where print gaps are made extremely small in order to maximize printing speeds.

While these ribbon shields have proven generally satisfactory in providing a degree of isolation between the ribbon and paper, these shields have nevertheless produced undesirable ink smudging on the paper as a result of edge friction produced by the ribbon dragging against the edge of the opening in the shield as the stylus (or hammer) drives the ribbon into contact with the paper. This dragging or wiping action which produces undesirable ink smudging is described in more detail below with respect to the prior art FIG. 1.

SUMMARY OF THE INVENTION

The general purpose of this invention is to eliminate the above problem of ink smudging caused by edge friction at the ribbon shield opening. This purpose is accomplished by the provision of a novel counter-bore construction which defines the geometry of the opening in the ribbon shield through which the stylus passes. In this construction, the ribbon shield is fabricated by the use of a first etch mask on one side of a stainless steel substrate and the use of a second etch mask on the opposite side of the substrate, with an opening in the second etch mask being greater than an opening in the first etch mask by a predetermined amount. When the metal shield-substrate member is now exposed to a selected chemical etchant, a stepped two-diameter opening is produced in this member, and the geometry of the shield between the first and second (smaller and larger) diameters is referred to herein as the ink reservoir or ink cavity. As the edge of the shield at the larger or second diameter opening wipes against the moving ink-containing ribbon, the excess ink desorbed and extracted therefrom becomes temporarily trapped in this ink reservoir or cavity, and thus becomes totally shielded from the paper on the other side of the shield. Thus, this novel ribbon shield construction constitutes a preferred embodiment of our invention and represents the best mode presently known for carrying out the invention.

Accordingly, it is an object of this invention to provide improved control over ink flow in impact printers having very small print gaps.

Another object of this invention is to provide an improved ribbon shield construction which enables the distance between the ink ribbon and paper to be minimized, thereby optimizing print speeds.

Another object is to provide a novel ribbon shield of the type described which is easy to fabricate using conventional metal masking and etching steps and which may be used as direct replacements for existing ribbon shields without modification to existing impact printers using same.

These and other objects and features of this invention will become more readily apparent in the following description of the accompanying drawings.

DRAWINGS

DETAILED DESCRIPTION

Figure 1:
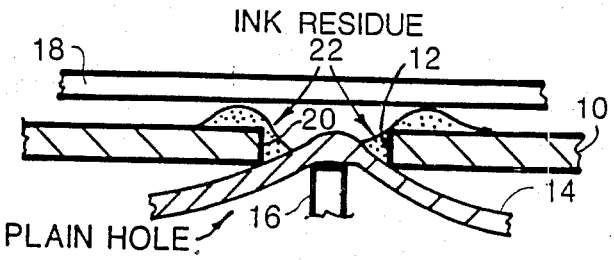
FIG 1 (PRIOR ART)
FIG. 1 is a cross sectional side view of a prior art ribbon shield construction which produces ink smudging at close paper-to-ribbon spacings.

Referring now to FIG. 1, there is shown a conventional prior art ribbon shield construction which includes a stainless steel ribbon shield member 10 having an opening 12 therein for receiving an ink containing ribbon 14. The ink containing ribbon 14 is driven vertically upward by a stylus or hammer member 16 where it impacts a sheet of paper 18 as it comes to rest against a platen (not shown). During the impact printing process, the lower edge 20 of the opening 12 in the ink shield 10 scrapes or wipes against the ink containing ribbon 14 and thereby causes ink residue puddles 22 to build up as shown on the ribbon surface and also on the top surface of the shield 10. When this happens, the ink residue puddles 22 come in contact with the paper 18 and thus cause ink smudging on the paper 18. It is this problem of ink smudging which has been eliminated by the present invention, as is described in more detail below.

Figure 2D:
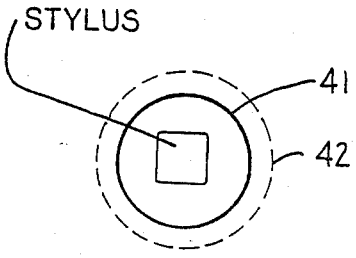
FIG. 2D shows the inner and outer diameters of the ribbon shield and the stylus centered therebetween.
Figure 2C:
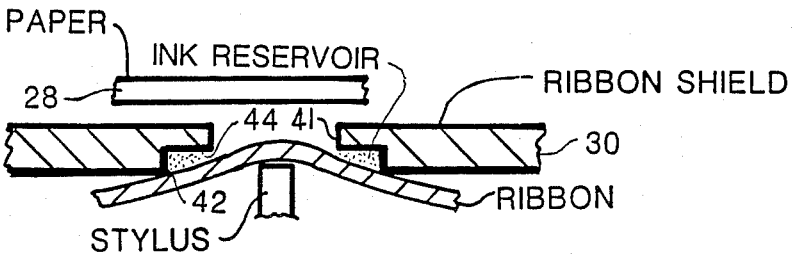
FIG. 2C is an enlarged cross sectional side view of the ribbon, stylus, ribbon shield, paper and platen of FIGS. 2A and 2B.
Figure 2A:
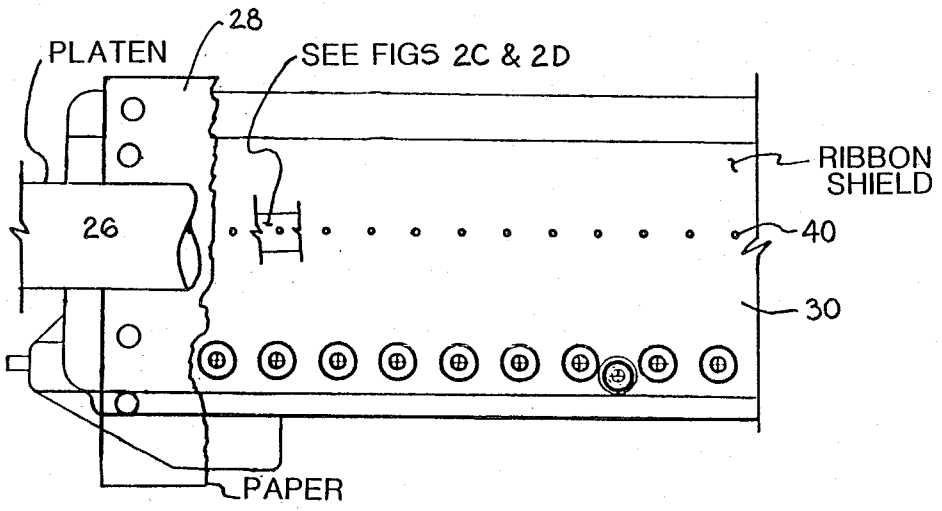
FIG. 2A is a partially cut-away isometric view of an impact printer utilizing the present invention.
Figure 2B:
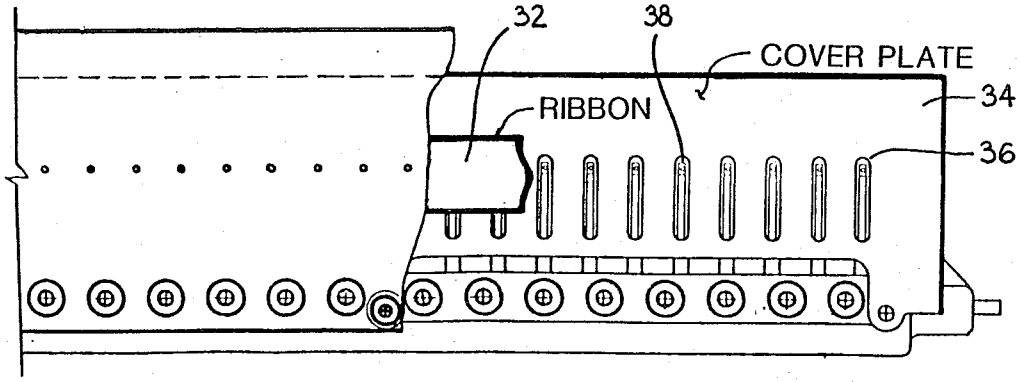
FIG. 2B is a partially cut-away isometric view showing the plurality of print hammers or stylii in relation to the cover plate, ribbon and ribbon shield, respectively.

Referring now to FIGS. 2A and 2B, there is shown in a sectioned cut-away view the various structural elements which make up an impact printer utilizing the present invention. These elements include a platen 26 upon which the paper 28 comes to rest during the impact printing step. The ribbon shield 30 is positioned as shown on the other side of the paper 28 and is positioned on top of the ink ribbon 32 which itself is located between the lower side of the ribbon shield 30 and the upper facing surface of a cover plate member 34. The cover plate member 34 includes a plurality of elongated openings 36 therein adapted to receive a corresponding plurality of impact print hammers or stylus members 38 as shown. These hammers or stylus members 38 are electromechanically driven through the elongated openings 36 and through the correspondingly aligned openings 40 in the ribbon shield 30 as the ribbon 32 is driven into contact with the paper 28, coming to rest against the platen 26.

Referring now to FIGS. 2C and 2D, there is shown the ribbon shield construction according to the present invention and including an opening 40 in the shield 30 defined by a first, smaller diameter 41 and a second, larger diameter 42. As the ribbon 32 drags or wipes against the lower edge 42 defining the larger diameter, there will occur a build up of ink 44 as shown. However, in accordance with the present invention, it has been discovered that the ink residue puddles 44 shown in FIG. 2C do not build up over the top surface of the shield 30, but rather remain in the position shown in FIG. 2C and therefore do not produce ink smudging on the paper 28. For best results, it has been found that the width of the smaller or first diameter opening 41 should be about 1.6 millimeters and the width of the second or larger diameter 42 should be about 2.0 millimeters, with the vertical thickness or depth of each of these diameters being approximately equal. The latter stepped diameter dimension is accomplished in the etching process described below with reference to FIGS. 3A and 3B.

Figure 3A:
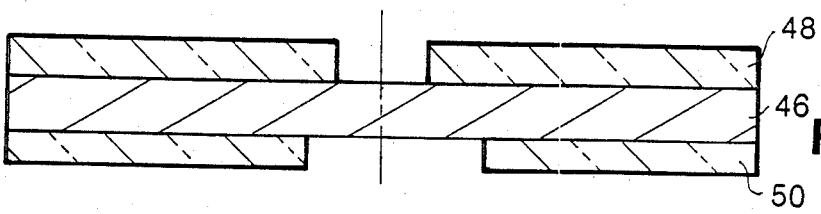
FIGS. 3A and 3B illustrate the masking and etching steps utilized to produce the ribbon shield construction according to the present invention.
Figure 3B:
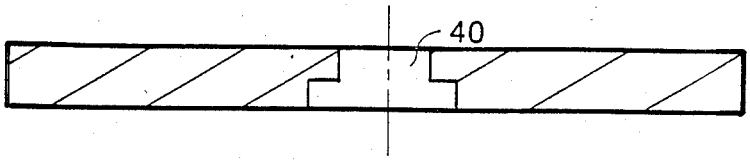

Referring now to FIG. 3A, the ribbon shield according to the present invention is fabricated by masking a stainless steel substrate member 46 with first and second etch resistant masks 48 and 50 as shown. Then, the masked structure of FIG. 3A is exposed to a known chemical metal etchant such as a ferrochloric acid for a predetermined time sufficient to remove the metal material to thus create the opening 40 as shown in FIG. 3B.

Various modifications may be made to the above described preferred embodiment of the invention without departing from the scope thereof. For example, the size and geometry of the small diameter-large diameter opening 40 may be varied by those skilled in the art in order to more readily adapt the ribbon shield for a particular impact printer construction and ribbon-to-paper spacing. Accordingly, the invention may be practiced other than as specifically described above and still be within the scope of the following appended claims:

We claim:

1. A method for preventing residual ink stored in an absorbent ribbon on one side of a ribbon shield from being transferred through an opening in the shield to paper on the other side thereof, comprising:

(a) providing a step contoured recessed cavity in said shield adjacent the periphery of said opening and encircling a ribbon stylus, wherein said recessed cavity forms a lower edge at a point of minimum diameter and an upper edge at a point of maximum diameter, said upper edge being closer to said ribbon than said lower edge, and (b) wiping said ribbon with the lower edge of said cavity by passing said ribbon across said lower edge and then through said opening toward said paper and across the upper edge of said cavity, whereby ink removed from said ribbon during wiping accumulates in said cavity where it is thereby restrained from flowing to said paper.

2. In an impact printer arrangement including a platen against which a stylus hammer drives an ink containing ribbon to form a character on a sheet of paper, and including a ribbon shield positioned between the ribbon and paper to minimize unintentional contact between said ribbon and paper, the improvement comprising: a metal shield having an opening of stepped contour therein, said opening surrounding said stylus hammer and having first and second diameters, with said first diameter being smaller than said second diameter by a predetermined amount, and said first diameter defining a portion of said opening adjacent said paper and said second diameter defining a portion of said opening adjacent said ribbon and forming with said first diameter opening a reservoir cavity, said cavity being defined by one surface substantially parallel to said paper and one surface substantially perpendicular to said paper, said cavity having inner surfaces facing toward said ribbon and being operative to scrape ink from said ribbon by edge friction between said ribbon and said second diameter opening, whereby said reservoir cavity tends to accumulate residual ink therein and tends to prevent or impede the flow of residual ink therein to said paper, and eliminate or minimize ink smudging thereon.

3. The improvement defined in claim 2 wherein said first diameter opening is on the order of 1.6 millimeters and the diameter of said second diameter opening is on the order of 2.0 millimeters.

4. The improvement defined in claim 2 wherein the vertical thickness defining said first and second diameter openings are equal.

5. The improvement defined in claim 3 wherein the vertical thickness defining said first and second diameter openings are equal.

6. A method for restraining movement of excess ink from an absorbent ribbon toward an adjacent paper which comprises:

a. providing a ribbon shield between said paper and ribbon having an L-shaped cavity with inner surfaces and first and second edges, said inner surfaces facing toward the ribbon and said inner surfaces being bounded by said first and second edges which are defined by mutually orthogonal surfaces, with said first and second edges being laterally displaced from each other by different predetermined dimensions, to form said L-shaped cavity, said first edges being spaced a greater distance apart than said second edges, b. sequentially passing said ribbon over one of said first edges, one of said second edges, towards said paper, over the other of said second edges and, finally, over the other of said first edges, while simultaneously c. accumulating excess ink from said ribbon into said L-shaped cavity.

* * * * *